US011126214B1

(12) United States Patent
Tu

(10) Patent No.: US 11,126,214 B1
(45) Date of Patent: Sep. 21, 2021

(54) STOVE KNOB CAPABLE OF AUTOMATICALLY SHUTTING DOWN A STOVE IN COOPERATION WITH HEAT

(71) Applicant: Tse-Ju Tu, Taoyuan (TW)

(72) Inventor: Tse-Ju Tu, Taoyuan (TW)

( * ) Notice: Subject to any disclaimer, the term of this patent is extended or adjusted under 35 U.S.C. 154(b) by 0 days.

(21) Appl. No.: 17/162,277

(22) Filed: Jan. 29, 2021

(30) Foreign Application Priority Data

Apr. 22, 2020 (TW) ..... 109204768

(51) Int. Cl.
*G05G 1/12* (2006.01)
*G05G 1/08* (2006.01)
*F24C 3/12* (2006.01)

(52) U.S. Cl.
CPC ..... *G05G 1/082* (2013.01); *F24C 3/122* (2013.01); *G05G 1/12* (2013.01)

(58) Field of Classification Search
CPC ..... G05G 1/08; G05G 1/082; G05G 1/10; G05G 1/12; F24C 3/12; F24C 3/122; F24C 3/124; F24C 3/126; F24C 7/08; F24C 7/081; F24C 7/082; H01H 3/10; H01H 3/08; H01H 19/14; H01H 25/06
See application file for complete search history.

(56) References Cited

U.S. PATENT DOCUMENTS 3,541,882 A * 11/1970 Testa ..... G05G 1/10 74/553
2003/0154970 A1* 8/2003 Huang ..... F24C 3/124 126/39 R
2014/0033857 A1* 2/2014 Currier ..... G05G 1/12 74/553
2016/0378130 A1* 12/2016 Finley ..... G05G 5/005 74/527

FOREIGN PATENT DOCUMENTS

WO WO-2009038483 * 3/2009 ..... H01H 25/04
WO WO-2014016114 * 1/2014 ..... F24C 3/12

* cited by examiner

*Primary Examiner* — Richard W Ridley
*Assistant Examiner* — Brian J McGovern
(74) *Attorney, Agent, or Firm* — Rosenberg, Klein & Lee

(57) ABSTRACT

A stove knob capable of automatically shutting down a stove in cooperation with heat includes a knob body, an adapter module and a steering joint. The adapter module and the steering joint are selected to be individually or mutually pivoted and then installed between the knob body and the ignition shaft of the stove, and the knob body can be installed to an automatic thermal shutdown machine to fit the use of various different stoves and achieve the effect of expanding the scope of use. The knob body, the adapter and the steering joint can pivotally combined by different orientations and pivotally connected to an ignition shaft of the stove in a predetermined direction, so that a rotary handle of the knob body can be aligned with the best direction and angle towards a user to provide smooth and convenient operations.

14 Claims, 13 Drawing Sheets

STOVE KNOB CAPABLE OF AUTOMATICALLY SHUTTING DOWN A STOVE IN COOPERATION WITH HEAT

BACKGROUND OF THE INVENTION

Field of the Invention

The present invention relates to a stove knob for automatic thermal shutdown machines, and more particularly to a stove knob with the features of easy installation, simple and convenient assembly procedure that can be applied to an automatic thermal shutdown machine, and the stove knob can expand the scope of use and maintain the smoothness and convenience of the operation without changing existing operating habits, and also complies with practical use and user requirements.

Description of the Related Art

There are many kinds of stoves such as gas stoves, electric stoves, etc. used for cooking, and these stoves not only come with different brands and models in Taiwan, but also provide various forms of stoves to cope with the using habits or operating methods for each country of the world.

During the use of the stoves, people often forget to turn off the heat source (such as gas or electricity), which causes empty burning of cooking utensils or even causes accidents such as fire. Therefore, the applicant of this invention has provided an automatic thermal shutdown machine along with the use of the existing stoves (as disclosed in R.O.C. Pat. No. M554154), and this automatic thermal shutdown machine is installed at an ignition shaft position of a stove. When a knob of the automatic thermal shutdown machine is turned to ignite the stove for cooking or boiling water or soup, the automatic thermal shutdown machine can be set with a desired time of using heat energy, and the automatic thermal shutdown machine will drive the knob to turn in a reverse direction to automatically cut off the heat source when the set time arrives, so that man-made accidents or fire can be avoided when the users accidentally forget to turn off the heat source. This automatic thermal shutdown machine can be used with a stove to provide the expected effect and performance, and thus it has been highly recommended by the market after its launch.

As we know that most of the installation methods and forms of the ignition knob and the ignition shaft are as shown in FIGS. 1 and 2, wherein the ignition knob 10 includes a shaft hole 102 having an anti-rotation matching surface 101 and formed on a side of the ignition knob 10 for precisely aligning and plugging an ignition shaft 11 with a corresponding matching surface 111, and the matching surfaces 101, 111 are combined, and the ignition knob 10 definitely will rotate with the ignition shaft 11 when no idling occurs, so that a rotary handle 103 disposed on the other side of the ignition knob 10 will be able to follow the angle of rotation of the ignition shaft 11 to stabilize the using status of the corresponding gas fire. For example, if the stove has not ignited or is shut, the rotary handle 103 of the ignition knob 10 is mostly set to a vertical angle, and when the stove fire is adjusted, the rotary handle 103 is slightly turned in a forward or reverse direction, and the ignition shaft 11 is rotated altogether. In other words, for the convenience and smoothness of the operation, when the ignition knob 10 is installed to the ignition shaft 11, the rotary handle 103 of the ignition knob 10 must be configured with a corresponsive predetermined angle (such as the vertical status when the stove fire has not ignited). To ensure that the rotary handle 103 is rotated to the expected predetermined angle, it is necessary to take the angle and position of the corresponding matching surface 111 of the ignition shaft 11 of the stove into consideration in advance before manufacturing the matching surfaces, when a mold is opened to manufacture the matching surface 101 of the shaft hole 102 of the ignition knob 10.

However, there are various forms and types of stoves as described above, and the diameter and length of the ignition shaft 11 of every stove often vary, and the angle and position of the matching surface 111 of each ignition shaft 11 often vary too. Therefore, the ignition knob 10 mounted on the ignition shaft 11 usually has its own form, and the ignition knobs manufactured by different manufacturers cannot be shared, and the inventor of the present invention based on years of experience in the related industry to conduct extensive research and experiment, and finally developed a stove knob capable of automatically shutting down a stove in cooperation with heat in accordance with the present invention, in hope of applying the stove knob conveniently, smoothly and universally for various different stoves.

SUMMARY OF THE INVENTION

Therefore, it is a primary objective of the present invention to provide a stove knob capable of automatically shutting down a stove in cooperation with heat to overcome the aforementioned drawbacks of the prior art, and the stove knob of the automatic thermal shutdown machine can be used in various forms or types of stoves to achieve the effects of providing a wide range of use, and a smooth and convenient operation.

To achieve the aforementioned and other objectives, the present invention discloses a stove knob capable of automatically shutting down a stove in cooperation with heat, and the stove knob comprises a knob body, an adapter module, and a steering joint, and the adapter module and the steering joint are selected to be individually pivoted or pivoted with each other first and then installed between the knob body and the ignition shaft of the stove, and the knob body can be installed to an automatic thermal shutdown machine to fit the use of various kinds of stoves and achieve the effect of expanding the scope of use. In addition, the knob body, the adapter and the steering joint can be pivotally combined with one another with different orientations and pivotally coupled to an ignition shaft of the stove in a predetermined direction, so that a rotary handle of the knob body can be aligned with the best direction and angle towards a corresponding user to provide a smooth and convenient operation.

The present invention will become clearer in light of the following detailed description of an illustrative embodiment of this invention described in connection with the drawings.

DETAILED DESCRIPTION OF THE PREFERRED EMBODIMENTS

Figure 1:
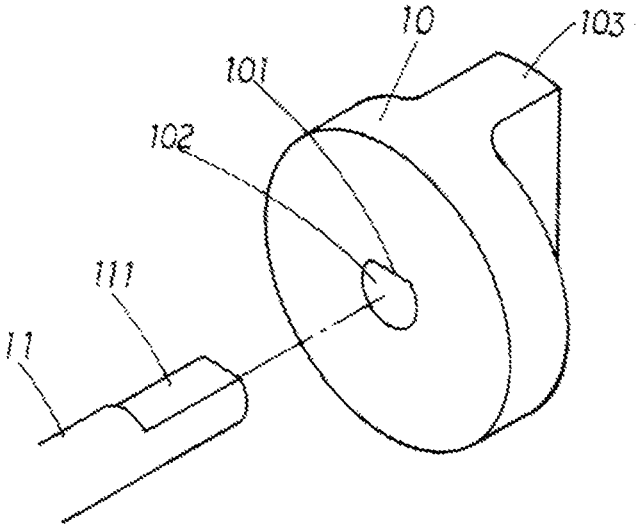
FIG.1 PRIOR ART
FIG. 1 is a perspective view showing the relative positions of an ignition knob and an ignition shaft of a conventional stove.
Figure 2:
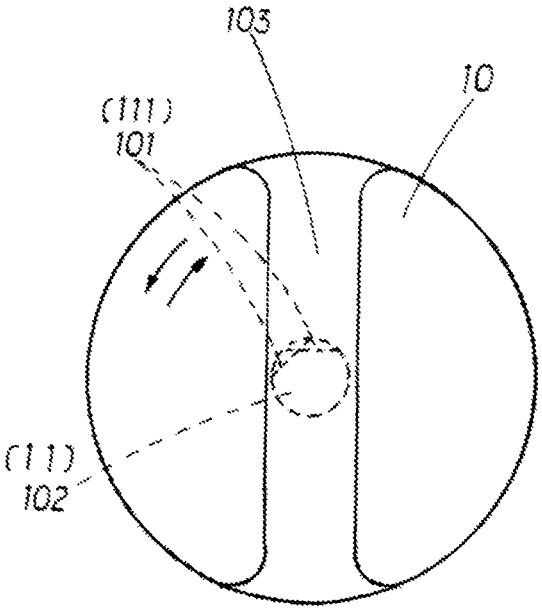
FIG.2 PRIOR ART
FIG. 2 is a schematic planar view showing the operation of the ignition knob and the ignition shaft the conventional stove.

With reference to FIGS. 3 to 7 for a stove knob capable of automatically shutting down a stove in cooperation with heat in accordance with the present invention, the stove knob comprises a knob body 20, an adapter module 30 and a steering joint 40, and the adapter module 30 and the steering joint 40 are selected to be individually pivoted or pivoted to each other first and then installed with a selected orientation and a non-rotational pivoting assembly between the knob body 20 and the ignition shaft 11 of the stove; wherein the knob body 20 comprises a rotary handle 201 disposed at a side end of the knob body 20, a pivot body 202 disposed at an opposite end of the rotary handle 201, and a first pivot hole 2021 and a second pivot hole 2022 communicating with each other and formed on the pivot body 202 in an axial direction, and the first pivot hole 2021 is smaller than the second pivot hole 2022 and disposed at an inner end of the pivot body 202, and the second pivot hole 2022 is larger than the first pivot hole 2021 and disposed at the other end of the pivot body 202, and the circumferential surface of the second pivot hole 2022 has a plurality of outer female engaging surfaces or engaging teeth 20221; wherein the outer female engaging surfaces or engaging teeth 20221 disposed at the second pivot hole 2022 are preferably arranged with an equal angle relative to one another, and the included angle between any two adjacent outer female engaging surfaces 20221 is preferably 135 degrees; the first pivot hole 2021 preferably uses the plurality of outer female engaging surfaces or engaging teeth 20221 disposed on the circumferential surface of the second pivot hole 2022 as a base to provide a plurality of inner engaging surfaces 20211 or engaging teeth with the same orientation and extending from the circumferential surface.

The adapter module 30 comprises a first adapter 301 and a second adapter 302, and the first adapter 301 and the second adapter 302 are selected to be individually or mutually pivoted, and then installed with a selected orientation and a non-rotational pivoting assembly between the pivot body 202 of the knob body 20 and the ignition shaft 11 of the stove; wherein the first adapter 301 has a first inner coupling shaft 3011 and a first outer coupling shaft 3012 installed thereon in an axial direction, and the first inner coupling shaft 3011 is pivotally coupled to the first pivot hole 2021 of the knob body 20, and the circumferential surface of the first outer coupling shaft 3012 is set to be the same as the circumferential surface of the second pivot hole 2022 of the knob body 20 and has a plurality of first outer male engaging surfaces or engaging teeth 30121 that can be passed and engaged with one another, so that the first outer coupling shaft 3012 can be non-rotationally and pivotally coupled to the second pivot hole 2022 and the first adapter 301 can be non-rotationally and pivotally coupled to the knob body 20, and the first outer coupling shaft 3012 has an first external hole 30122 of a predetermined depth formed at an opposite end of the first inner coupling shaft 3011, and the circumferential surface of the first external hole 30122 has a plurality of first outer female engaging surfaces or engaging teeth 301221, and the circumferential surface of the first inner coupling shaft 3011 is set to be the same as the circumferential surface of the first external hole 30122 and has a plurality of first inner male engaging surfaces or engaging teeth 30111 that can be engaged with one another, and the first inner coupling shaft 3011 has a first shaft hole 3013 formed in an axial direction and communicating with the first external hole 30122, and the first shaft hole 3013 is provided for passing and installing the ignition shaft 11 of the corresponding stove, and the first shaft hole 3013 has an anti-rotation matching surface 30131 provided for passing and engaging the anti-rotation matching surface 111 of the ignition shaft 11, so that the first adapter 301 is pivoted to the integral knob body 20 without idling and can be coaxially pivoted to the ignition shaft 11; wherein the plurality of first outer female engaging surfaces or engaging teeth 301221 of the first external hole 30122 and the plurality of first inner male engaging surface or engaging teeth 30111 of the first inner coupling shaft 3011 are preferably set to be the same orientation of the first outer male engaging surfaces or engaging teeth 30121 of the first outer coupling shaft 3012. Besides the second adapter 302 having the first shaft hole 3013 with a size different from that of the second shaft hole 3023 of the first adapter 301 and an anti-rotation matching surface 30231, the remaining parts are the same as the first adapter 301. In other words, the second adapter 302 has a second inner coupling shaft 3021 and a second outer coupling shaft 3022 which are the same as the first inner coupling shaft 3011 and the first outer coupling shaft 3012 of the first adapter 301 respectively; and the second adapter 302 has a second inner male engaging surface or engaging teeth 30211 disposed at the second inner coupling shaft 3021, which are the same as the first inner male engaging surface or engaging teeth 30111 of the first adapter 301; the second adapter 302 has a plurality of second outer male engaging surfaces or engaging teeth 30221 disposed on the second outer coupling shaft 3022 which are the same as the first outer male engaging surfaces or engaging teeth 30121 of the first adapter 301; the second adapter 302 has a second external hole 30222 and a plurality of second outer female engaging surfaces or engaging teeth 302221 disposed on the second outer coupling shaft 3022 which are the same as the first external hole 30122 and the first outer female engaging surface or engaging teeth 301221 of the first adapter 301; so that the second inner coupling shaft 3021 of the second adapter 302 can be freely pivoted to the first external hole 30122 of the first adapter 301 without turning, or passed and installed to the first pivot hole 2021 of the knob body 20, so that the second outer coupling shaft 3022 of the second adapter 302 can be freely pivoted to the second pivot hole 2022 of the knob body 20 without turning, or the second outer coupling shaft 3022 of the second adapter 302 can be jointly pivoted to the second pivot hole 2022 of the knob body 20 after the second inner coupling shaft 3021 is pivoted to the first external hole 30122 of the first adapter 301. In other words, in response to the difference in size and length of the ignition shaft 11 of the stove, the first adapter 301 and the second adapter 302 respectively having the first shaft hole 3013 and the second shaft hole 3023 for passing and sheathing the ignition shaft 11 are selected to be individually pivoted with a selected orientation between the knob body 20 and the corresponding ignition shaft 11, or selected to be pivoted to the front and rear with each other, and installed with a selected orientation between the knob body 20 and the corresponding ignition shaft 11.

The steering joint 40 can be selectively pivoted to the first adapter 301 or the second adapter 302 of the adapter module 30 with a selected orientation and without turning, and pivotally installed between the knob body 20 and the ignition shaft 11 of the stove, and the circumferential surface of the steering joint 40 has a pivoting portion 401, and both ends of the pivoting portion 401 can be selectively pivoted with a selected orientation to the first external hole 30122 of the first adapter 301 or the second external hole 30222 of the second adapter 302, and a third shaft hole 402 and a fourth shaft hole 403 are formed at both ends of the pivoting portion 401 in an axial direction respectively, and the pivoting portion 401 also has a plurality of third male engaging surfaces or engaging teeth 4011 that can be passed, sheathed and fitted with one another and are the same as those formed on the circumferential surface of the first external hole 30122 of the first adapter 301 and the circumferential surface of the second external hole 30222 of the second adapter 302, and the third shaft hole 402 and the fourth shaft hole 403 have different sized hole diameters and each of them has an anti-rotation matching surface 4021, 4031 provided for passing and pivoting the ignition shaft 11 of different sizes and lengths of the stove.

Figure 5:
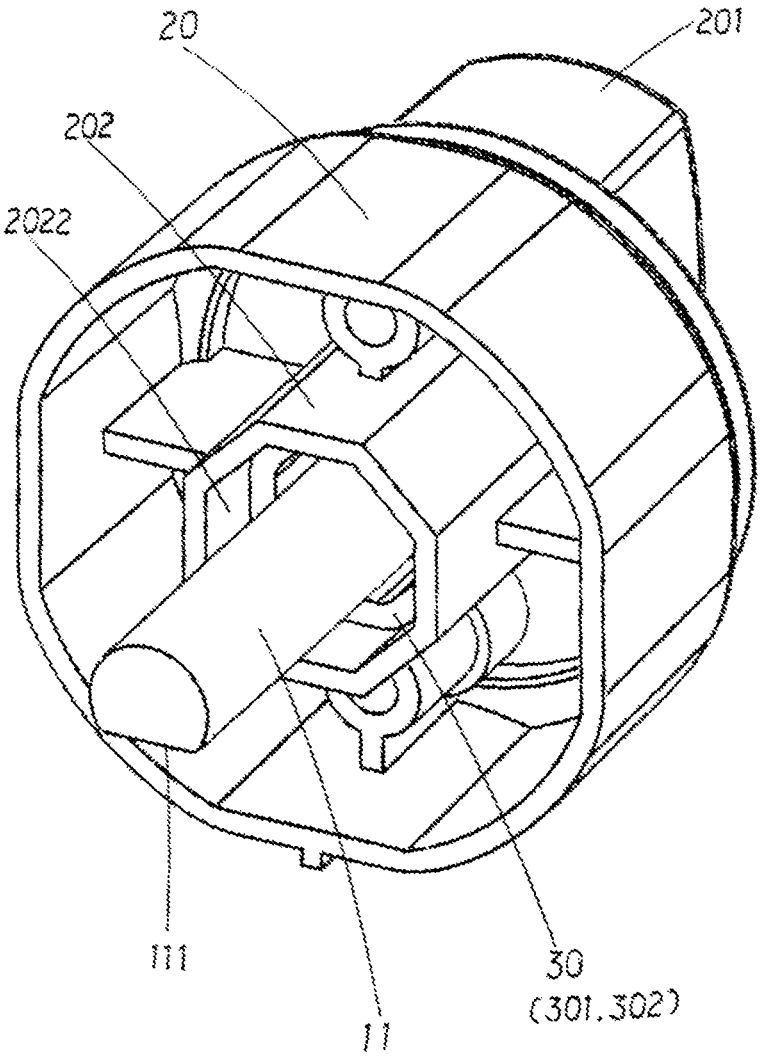
FIG. 5 is a perspective view of a first embodiment of the present invention.
Figure 6:
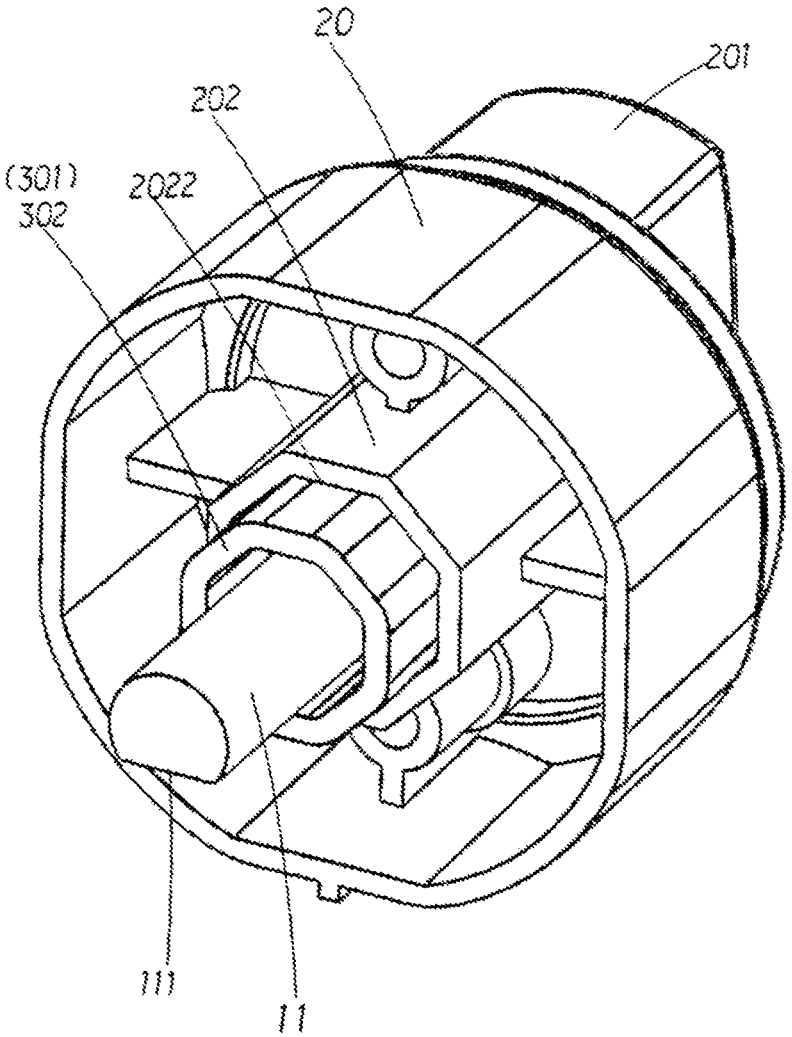
FIG. 6 is a perspective view of a second embodiment of the present invention.
Figure 7:
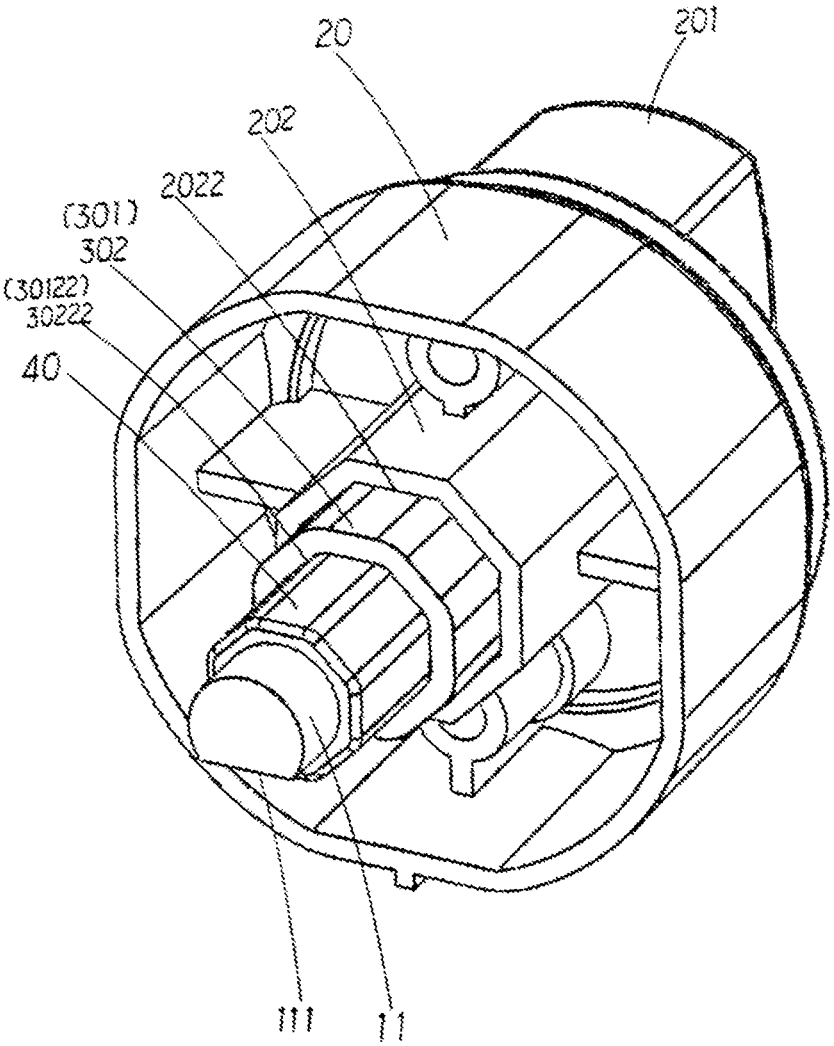
FIG. 7 is a perspective view of a third embodiment of the present invention.
Figure 8:
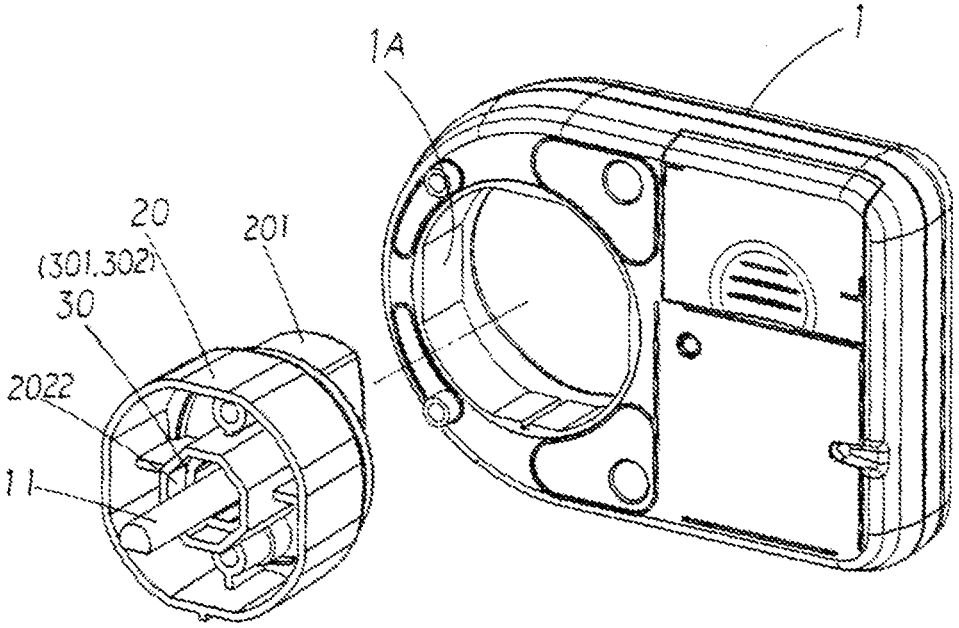
FIG. 8 is a perspective view showing the relative positions of the first embodiment of the present invention and an automatic thermal shutdown machine.
Figure 9:
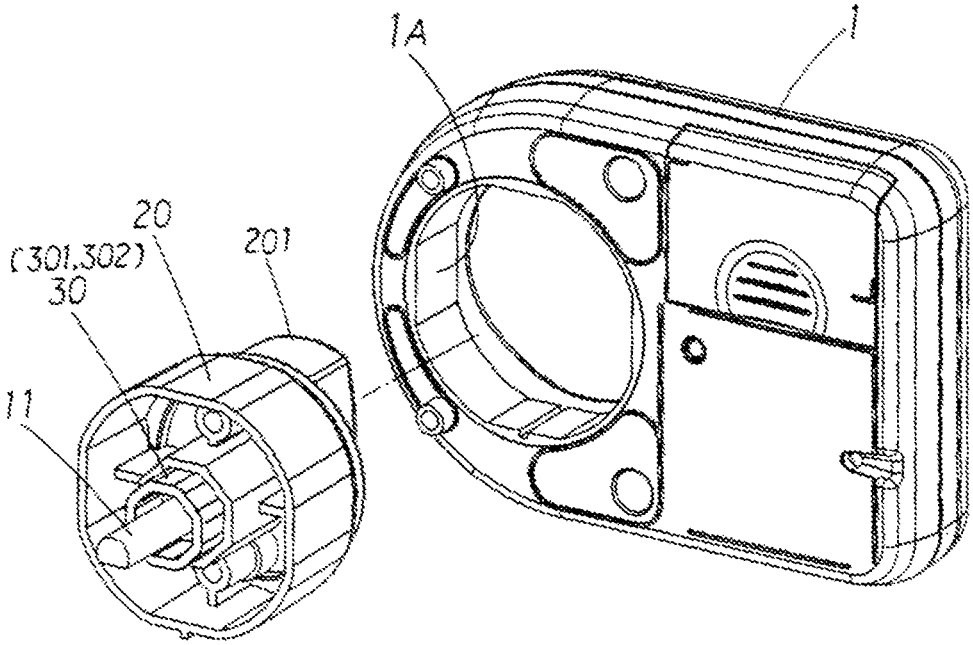
FIG. 9 is a perspective view showing the relative positions of the second embodiment of the present invention and the automatic thermal shutdown machine.
Figure 10:
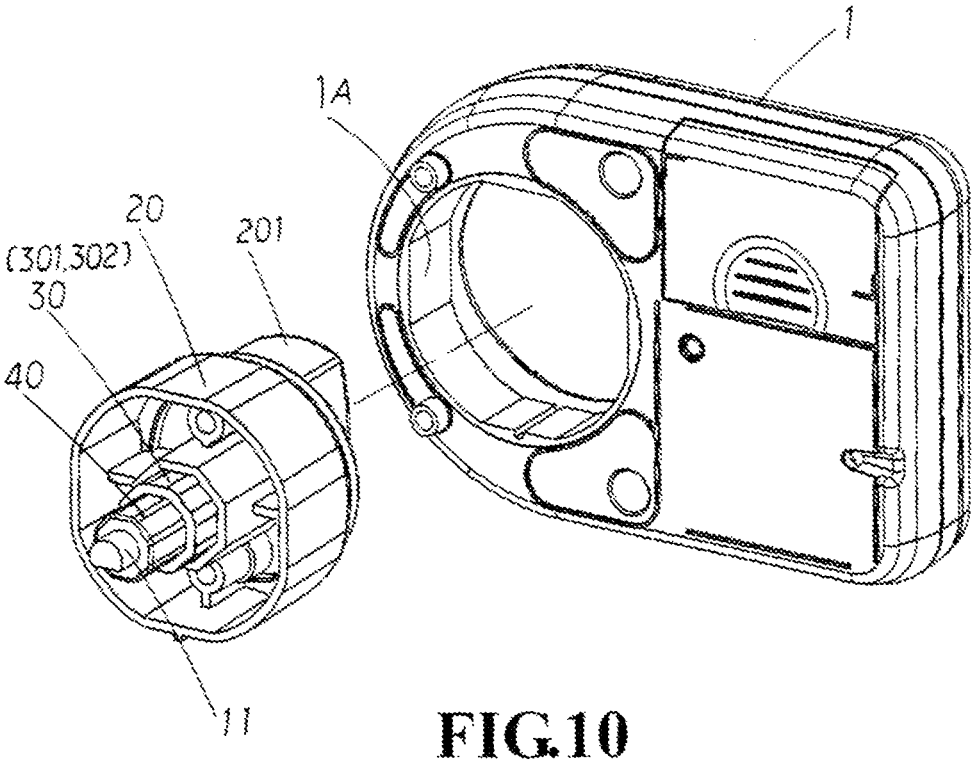
FIG. 10 is s perspective view showing the relative positions of the third embodiment of the present invention and the automatic thermal shutdown machine.
Figure 11:
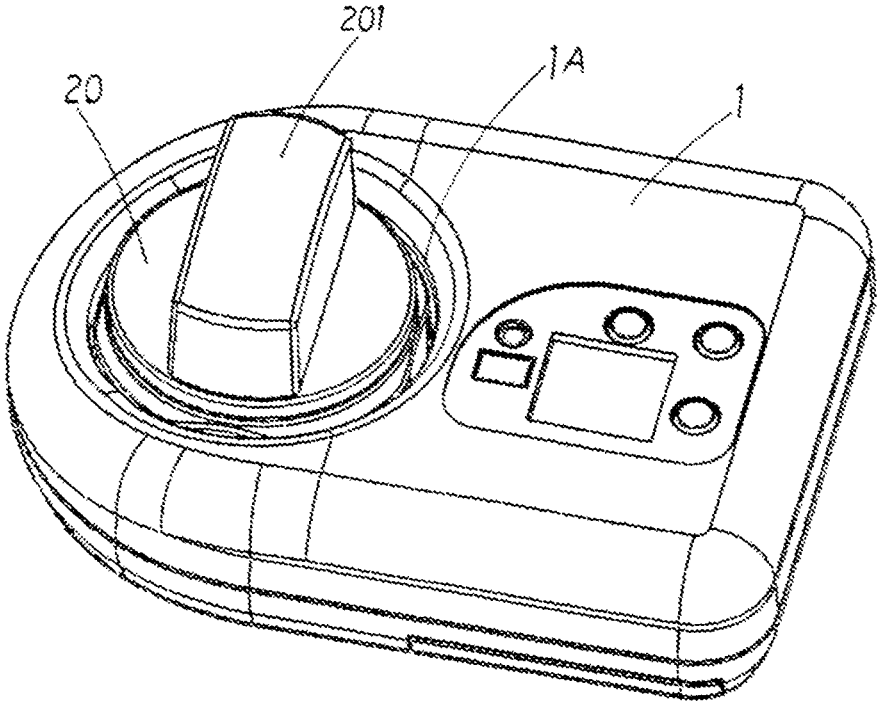
FIG. 11 is a perspective view of an embodiment of the present invention combined with the automatic thermal shutdown machine.

The present invention is formed according to the aforementioned structure. In FIGS. 8, 9, 10, and 11, the first adapter 301 or the second adapter 302 of the adapter module 30 can be selected to be individually installed between the knob body 20 and the ignition shaft 11 of the stove (as shown in FIGS. 5 and 8), and then the knob body 20 is passed and pivoted to a driving part 1A of the automatic thermal shutdown machine 1, and the rotary handle 201 is exposed for its operation (as shown in FIG. 11); or the first adapter 301 or the second adapter 302 of the adapter module 30 can be selected to pivoted with each other and then installed between the knob body 20 and the ignition shaft 11 of the stove (as shown in FIGS. 6 and 9), and the knob body 20 is passed and pivoted to the driving part 1A of the automatic thermal shutdown machine 1, and the rotary handle 201 is exposed for its operation (as shown in FIG. 11); or the first adapter 301 or the second adapter 302 of the adapter module 30 can be selected to be pivoted with each other and then pivoted to the steering joint 40 and installed between the knob body 20 and the ignition shaft 11 of the stove (as shown in FIGS. 7 and 10), and the knob body 20 is passed and pivoted to the driving part 1A of the automatic thermal shutdown machine 1, and the rotary handle 201 is exposed for its operation (as shown in FIG. 11).

With reference to FIGS. 12, 13, 14, 15, 16, and 17 for the front cross-sectional views of different embodiments of the present invention, the knob body 20, the adapter module 30 and the steering joint 40 are selectively pivoted with one another and then installed to the stove ignition shafts 11 of different sizes and lengths.

Figure 12:
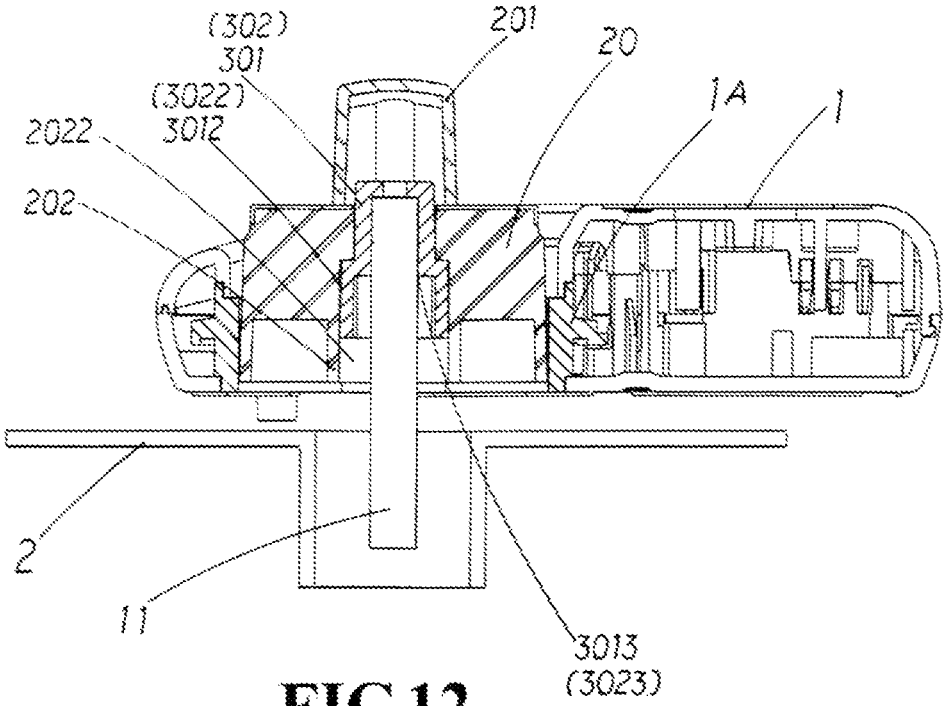
FIG. 12 is a front cross-sectional view of the first embodiment of the present invention.

In FIG. 12, when the present invention is applied to the ignition shaft 11 with a smaller shaft diameter (d=ϕ6 mm) and a longer length (l=30 mm) which is exposed from a stovetop of the stove 2, the adapter module 30 selectively includes the first adapter 301 or the second adapter 302 with a corresponding hole diameter which is individually installed between the ignition shaft 11 and the knob body 20. In other words, the first adapter 301 or the second adapter 302 having a first shaft hole 3013 or a second shaft hole 3023 with a shaft diameter corresponding to the ignition shaft 11 is pivoted to the ignition shaft 11 and then the pivot body 202 of the knob body 20 is aligned exactly to and plugged into the pivoted first adapter 301 or second adapter 302, so that the first outer coupling shaft 3012 of the first adapter 301 or the second outer coupling shaft 3022 of the second adapter 302 is pivoted and engaged to the second pivot hole 2022 of the knob body 20, and then the driving part 1A of the automatic thermal shutdown machine 1 is passed and installed to the knob body 20, and the automatic thermal shutdown machine 1 is securely attached to a stove top of the stove 2, and the rotary handle 201 of the knob body 20 can be stably exposed for the operation.

Figure 13:
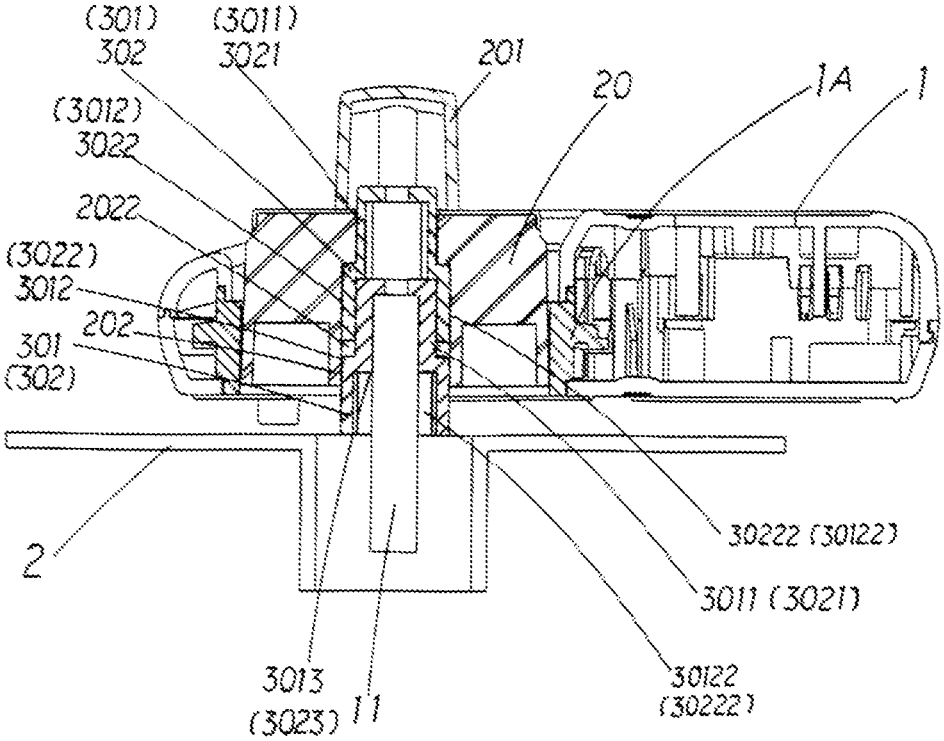
FIG. 13 is a front cross-sectional view of the second embodiment of the present invention.

In FIG. 13, when the present invention is applied to the ignition shaft 11 with a smaller shaft diameter (d=ϕ6 mm) and a shorter length (l=18 mm) which is exposed from a stovetop of the stove 2, the adapter module 30 selectively includes the first adapter 301 or the second adapter 302 with a corresponding hole diameter which is individually installed between the ignition shaft 11 and the knob body 20. In other words, the first adapter 301 or the second adapter 302 having a first shaft hole 3013 or a second shaft hole 3023 with a shaft diameter corresponding to the ignition shaft 11 is pivoted to the ignition shaft 11, but the other second adapter 302 or the first adapter 301 is idled, and its second external hole 30222 or first external hole 30122 is sheathed and pivoted to the first inner coupling shaft 3011 of the first adapter 301 or the second inner coupling shaft 3021 of the second adapter 302 disposed on the ignition shaft 11 to heighten and elongate the ignition shaft 11, and then the pivot body 202 of the knob body 20 is aligned exactly to and plugged into the pivoted first adapter 301 or second adapter 302, so that the first outer coupling shaft 3012 of the first adapter 301 or the second outer coupling shaft 3022 of the second adapter 302 is pivoted and engaged to the second pivot hole 2022 of the knob body 20, and then the driving part 1A of the automatic thermal shutdown machine 1 is passed and installed to the knob body 20, and the automatic thermal shutdown machine 1 is securely attached to a stove top of the stove 2, and the rotary handle 201 of the knob body 20 can be stably exposed for the operation.

Figure 14:
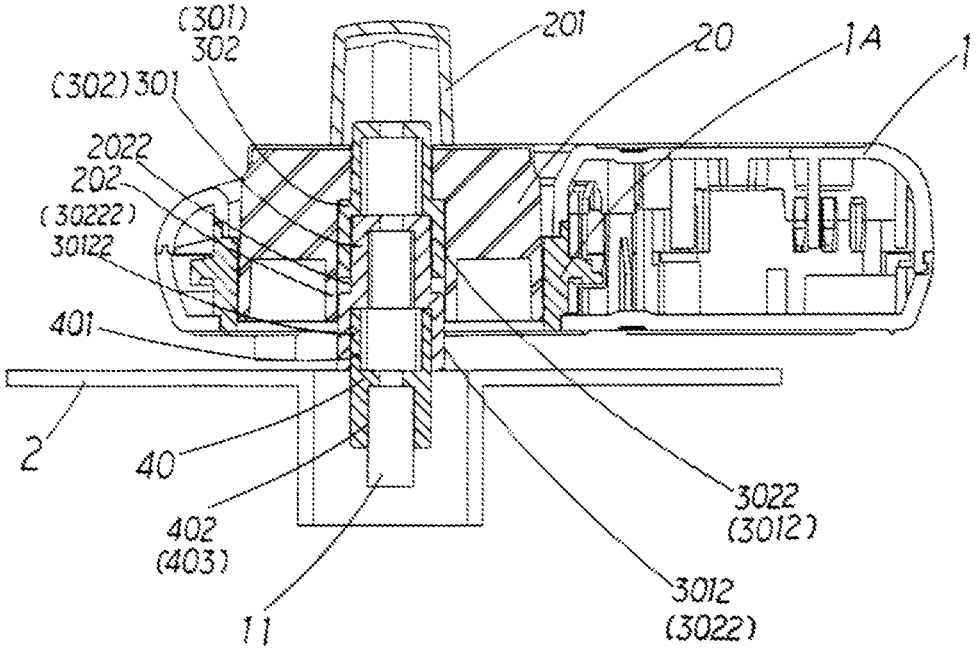
FIG. 14 is a front cross-sectional view of the third embodiment of the present invention.

In FIG. 14, when the present invention is applied to the ignition shaft 11 with a smaller shaft diameter (d=ϕ6 mm) and a shorter length which is retracted to a stovetop of the stove 2, the corresponding third shaft hole 402 or fourth shaft hole 403 of the steering joint 40 is selectively installed and pivoted to the ignition shaft 11, and then the first adapter 301 and the second adapter 302 of the adapter module 30 are pivoted as described above, and the pivoting portion 401 of the steering joint 40 is inserted and pivoted to the corresponding first external hole 30122 of the first adapter 301 or the corresponding second external hole 30222 of the second adapter 302, so that the ignition shaft 11 is heightened and elongated, and then the pivot body 202 of the knob body 20 is aligned precisely with and inserted into the already pivoted first adapter 301 or second adapter 302, so that the first outer coupling shaft 3012 of the first adapter 301 or the second outer coupling shaft 3022 of the second adapter 302 is pivoted and engaged to the second pivot hole 2022 of the knob body 20, and then the driving part 1A of the automatic thermal shutdown machine 1 is passed and installed to the knob body 20, and the automatic thermal shutdown machine 1 is securely attached to a stove top of the stove 2, and the rotary handle 201 of the knob body 20 can be stably exposed for the operation.

Figure 15:
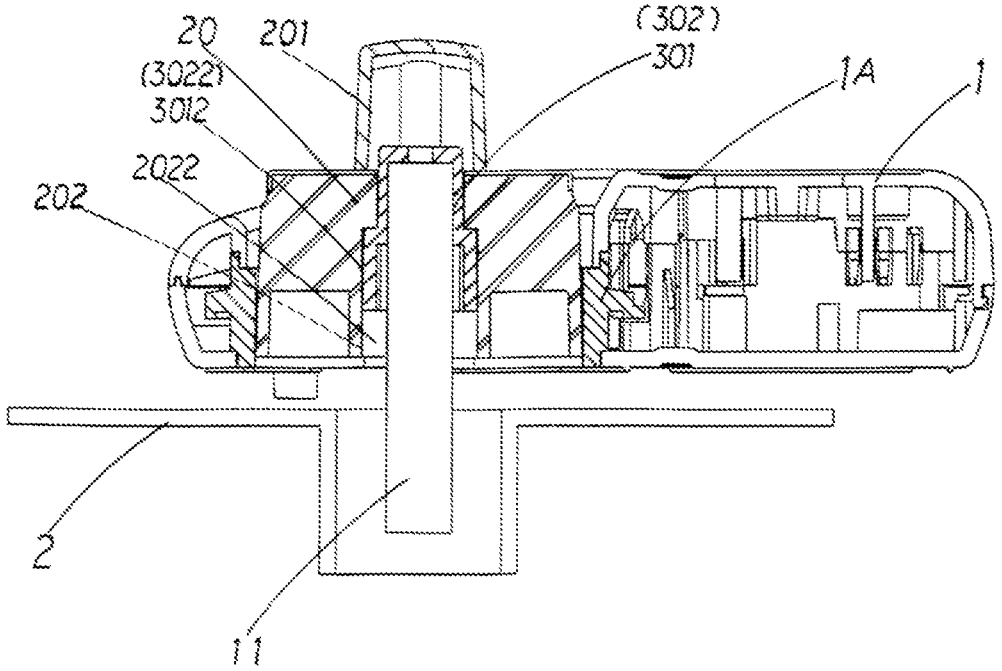
FIG. 15 is a front cross-sectional view of a fourth embodiment of the present invention.

In FIG. 15, when the present invention is applied to the ignition shaft 11 with a larger shaft diameter (d=ϕ8 mm) and a larger length (l=30 mm) which is exposed from the top of the stove 2, the assembling method is substantially the same as that illustrated in FIG. 12 except that the first adapter 301 or the second adapter 302 having a larger pivot hole diameter is selectively pivoted between the ignition shaft 11 and the knob body 20.

Figure 16:
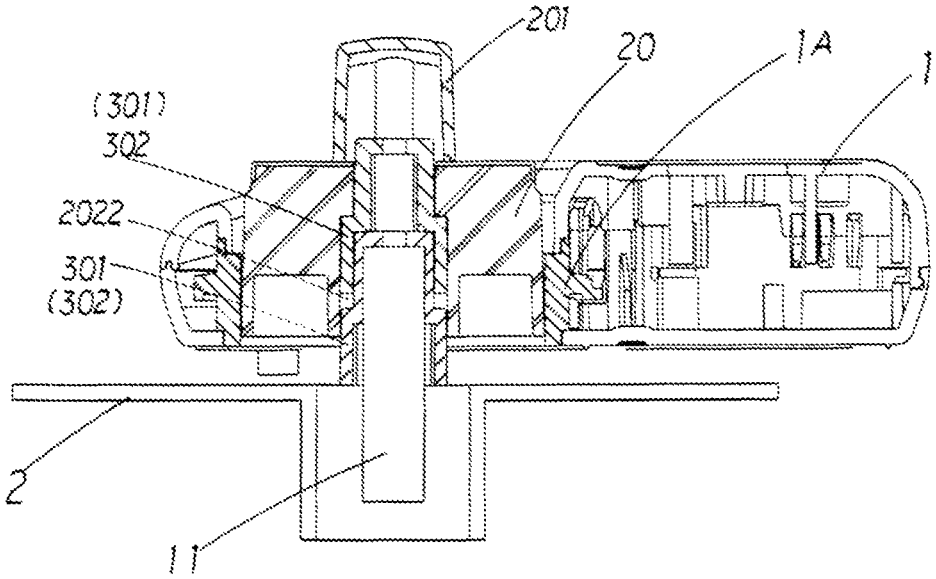
FIG. 16 is a front cross-sectional view of a fifth embodiment of the present invention.

In FIG. 16, when the present invention is applied to an ignition shaft 11 with a larger shaft diameter (d=ϕ8 mm) and a shorter length (l=18 mm) which is exposed from a stovetop of the stove 2, the assembling method is substantially the same as that illustrated in FIG. 13 except that the first adapter 301 or the second adapter 302 having a larger pivot hole diameter is pivoted to the ignition shaft 11 first.

Figure 17:
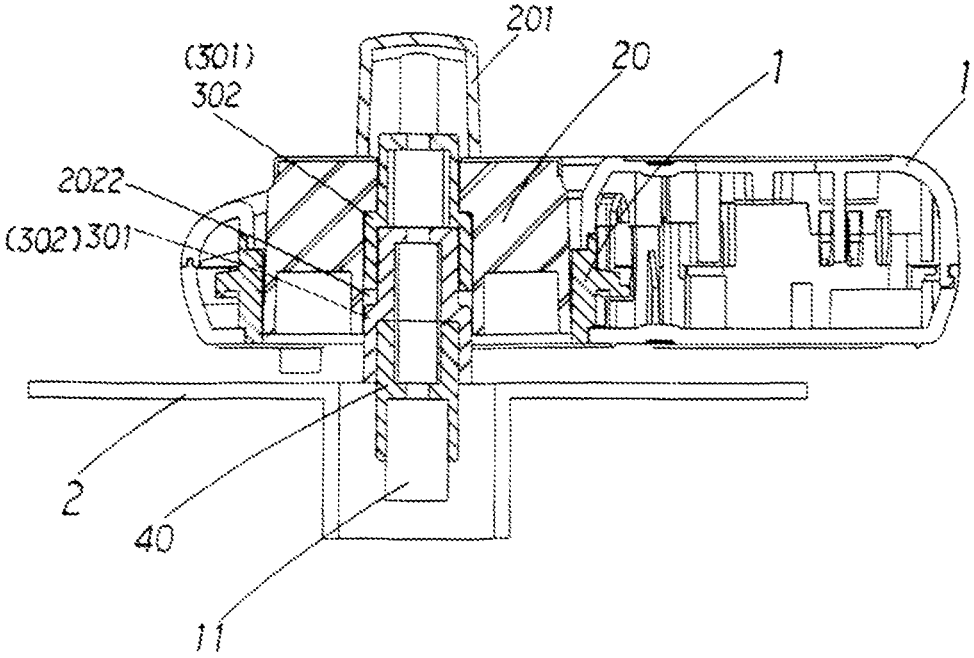
FIG. 17 is a front cross-sectional view of a sixth embodiment of the present invention.
Figure 18B:
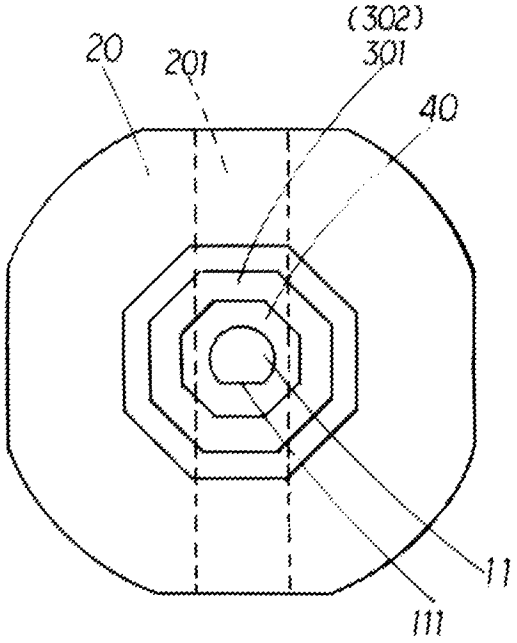
FIG. 18B is a second sectional view showing the mutual pivoting operation of a knob body, an adapter module, a steering joint and an ignition shaft of a stove in accordance with an embodiment of the present invention.
Figure 18A:
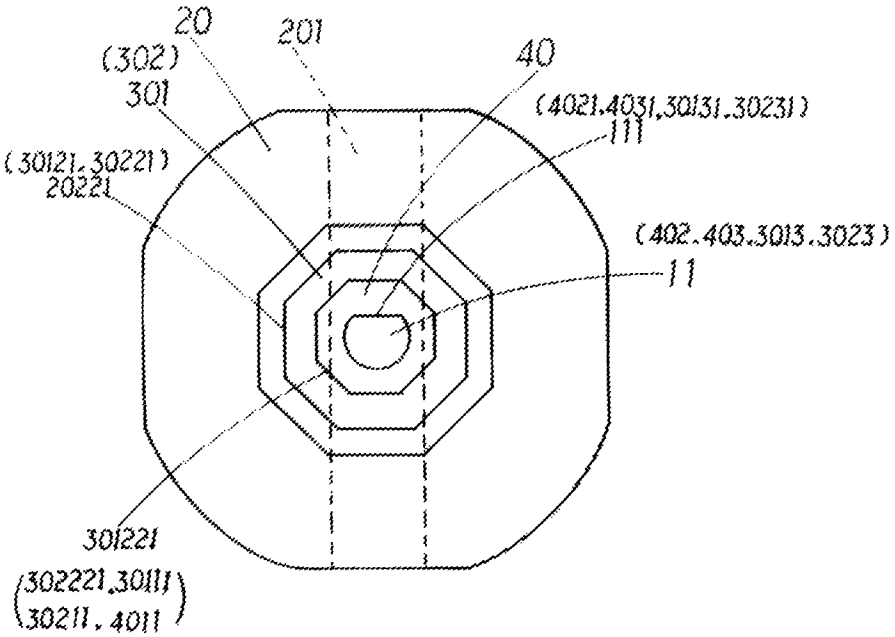
FIG. 18A is a first sectional view showing the mutual pivoting operation of a knob body, an adapter module, a steering joint and an ignition shaft of a stove in accordance with an embodiment of the present invention.
Figure 18D:
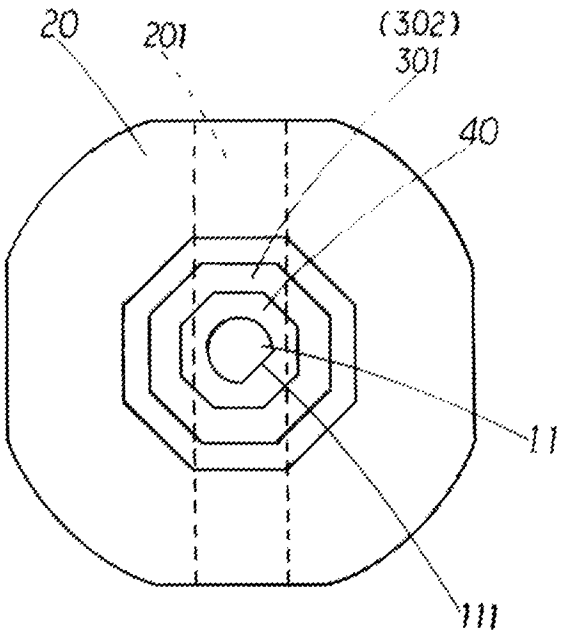
FIG. 18D is a fourth sectional view showing the mutual pivoting operation of a knob body, an adapter module, a steering joint and an ignition shaft of a stove in accordance with an embodiment of the present invention.
Figure 18C:
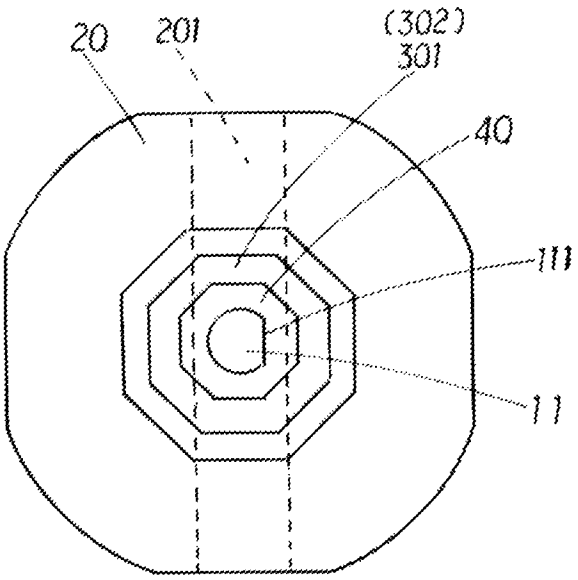
FIG. 18C is a third sectional view showing the mutual pivoting operation of a knob body, an adapter module, a steering joint and an ignition shaft of a stove in accordance with an embodiment of the present invention.

In FIG. 17, when the present invention is applied to an ignition shaft 11 with a larger shaft diameter (d=ϕ8 mm) and a shorter length retreated to the top of the stove 2 which is exposed from a stovetop of the stove 2, the assembling method is substantially the same as that illustrated in FIG. 14 except that the steering joint 40 with a larger pivot hole diameter is pivoted to the ignition shaft 11.

Figure 3:
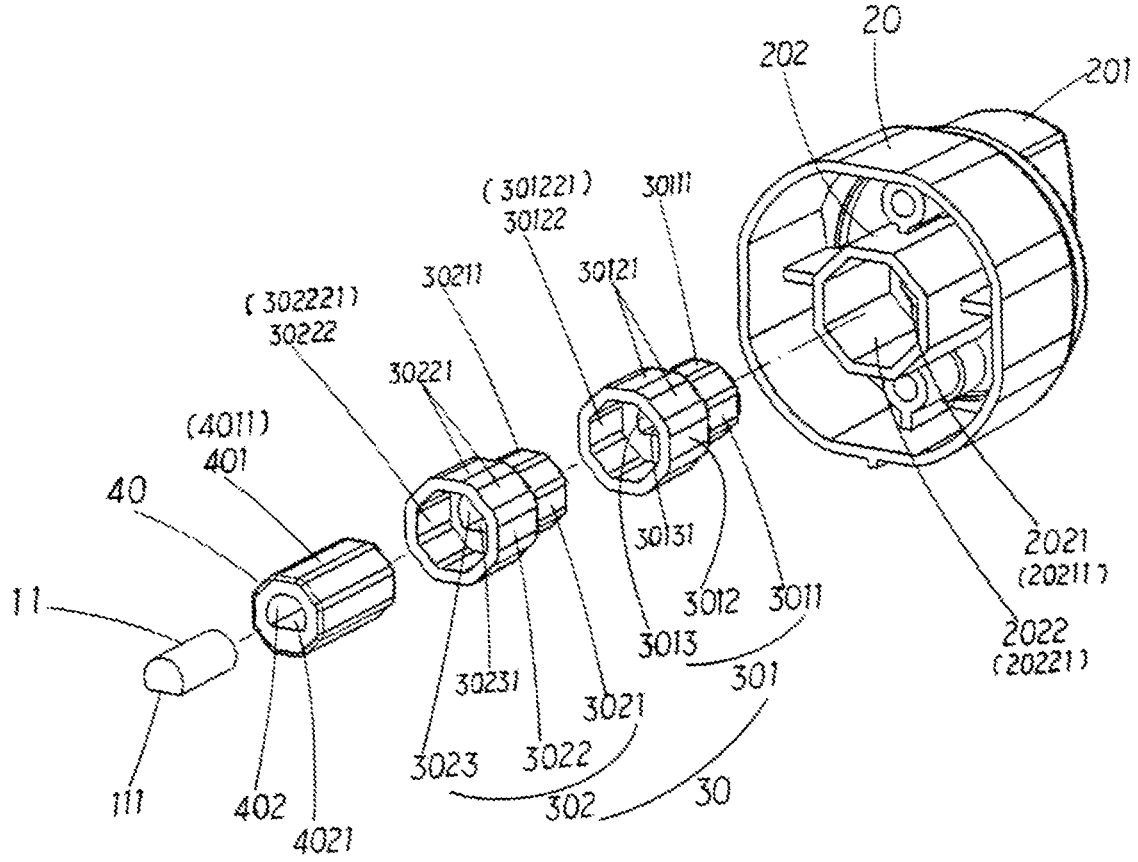
FIG. 3 is an exploded view showing the structure of the present invention.
Figure 4:
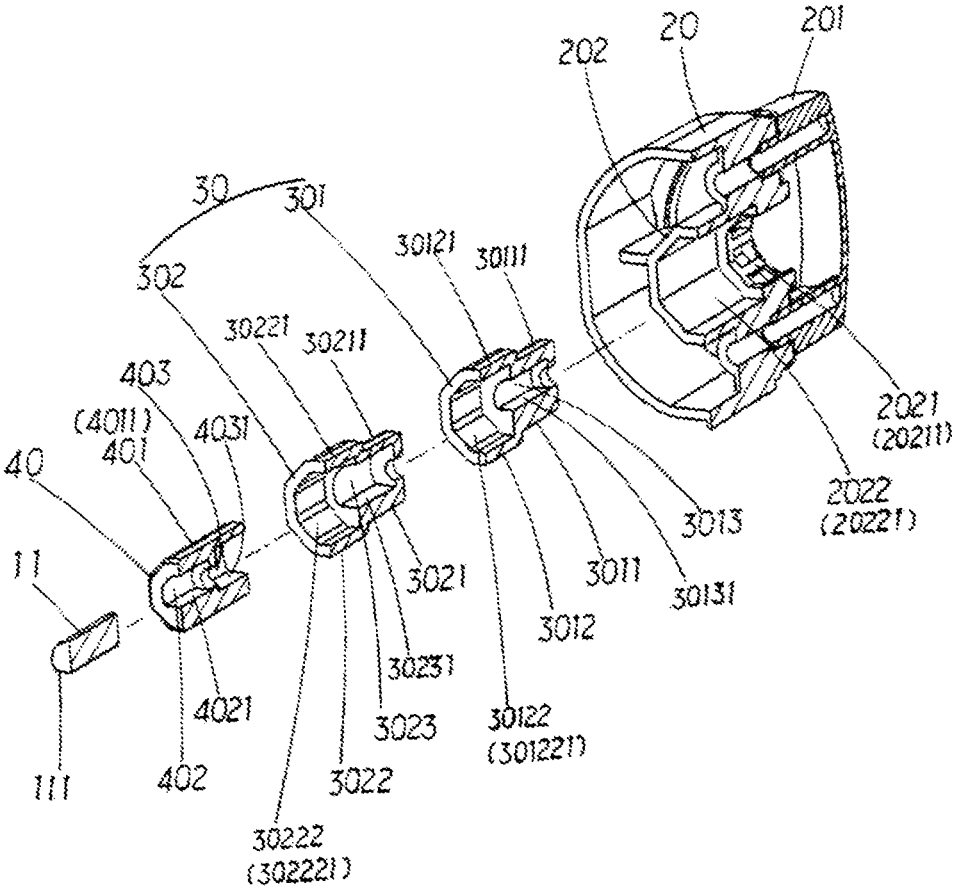
FIG. 4 is a cross-sectional view of FIG. 3.

In FIGS. 3, 4, and 18, all of the first adapter 301, the second adapter 302 and the steering joint 40 have an anti-rotation matching surface 30131, 30231, 4021, 4031 provided for pivoting the matching surface 111 of the ignition shaft 11, so that after the knob body 20 is pivoted to the first adapter 301 and the second adapter 302, the rotary handle 201 can be rotated to drive the ignition shaft 11 to rotate and achieve the effect of operating or adjusting the stove fire. Since the knob body 20, all of the first adapter 301, the second adapter 302 and the steering joint 40 have plurality of male and female engaging surfaces or engaging teeth 20221(30121, 30221), 301221(302221, 30111, 30211, 4011) that can be mutually pivoted, and they can be rotated freely under the condition of pivoting by different orientations. Naturally, after the first adapter 301, the second adapter 302 or the steering joint 40 is pivoted to the ignition shaft 11, the knob body 20 is selectively and preferably pivoted to the first adapter 301 or the second adapter 302 with the best set direction or angle, so that the rotary handle 201 of the knob body 20 can be situated in the best operating direction and angle. In other words, the ignition shaft 11 of various different stoves, regardless of being installed on the anti-rotation matching surface 111 at whatever angle or in whatever direction, such as the anti-rotation matching surface 111 being disposed at an upper horizontally cut position (as shown in FIG. 18A), a lower horizontally cut position (as shown in FIG. 18B), a right vertically cut position (as shown in FIG. 18C), or a right cut position with an included angle of 45 degrees (as shown in FIG. 18D) of the ignition shaft 11, and the first adapter 301, the second adapter 302 and the steering joint 40 are securely pivoted to the ignition shaft 11, and the knob body 20 can change the rotational direction freely and is pivoted with the best angle and direction to the first adapter 301 or the second adapter 302, so that the rotary handle 201 of the knob body 20 can be exposed at the best angle from the automatic thermal shutdown machine 1 (as shown in FIG. 11) for the convenient use and smooth operation of the stove.

In other words, the present invention at least has the following advantages:

1. The stove knob is easy-to-install and economic.
2. The assembly is simple, convenient, and easy-to-implement.
3. The stove knob can be used universally in various ignition shafts having different sizes and lengths, and has the effects of providing a multiple use and expanding the scope of use.
4. The stove knob has a knob body pivoted with an ignition shaft with an anti-rotation matching surface for different angles and orientations, so that the rotary handle can be exposed with the best angle from the automatic thermal shutdown machine to achieve smooth operations and convenient effects.

What is claimed is:

1. A stove knob capable of automatically shutting down a stove in cooperation with heat, comprising a knob body and an adapter module, and the knob body and the adapter module being installed to an ignition shaft of the stove with a selected orientation and a non-rotational pivoting connection, wherein the knob body has a rotary handle disposed at a side end of the knob body, a pivot body disposed at an opposite end of the rotary handle, and a first pivot hole and a second pivot hole communicating with each other and axially formed on the pivot body, and the first pivot hole being disposed at an inner end of the pivot body and the second pivot hole being disposed at an outer end of the pivot body;

the adapter module comprising a first adapter, individually installed with the selected orientation between the knob body and the corresponding ignition shaft, and the first adapter having a first inner coupling shaft and a first outer coupling shaft installed in an axial direction, and the first inner coupling shaft being coupled to the first pivot hole of the knob body, and the first outer coupling shaft being coupled with the selected orientation to the second pivot hole of the knob body, and the first inner coupling shaft having a first shaft hole formed along the axial direction and provided for passing and engaging the corresponding ignition shaft, wherein the second pivot hole of the knob body has a plurality of outer female engaging surfaces or engaging teeth formed on a circumferential surface of the second pivot hole, and the first pivot hole of the knob body uses the plurality of outer female engaging surfaces or engaging teeth on the circumferential surface of the second pivot hole as a base to form a plurality of inner female engaging surfaces or engaging teeth extending from a circumferential surface of the first pivot hole and with the same orientation; a circumferential surface of the first outer coupling shaft of the first adapter of the adapter module is set to be the same circumferential surface of the second pivot hole of the knob body and has a plurality of first outer male engaging surfaces or engaging teeth that can be passed and engaged with one another, and a circumferential surface of the first inner coupling shaft of the first adapter is set to be the same circumferential surface of the first pivot hole of the knob body and has a plurality of first inner male engaging surfaces or engaging teeth that can be passed and engaged with one another.

2. The stove knob capable of automatically shutting down a stove in cooperation with heat as claimed in claim 1, wherein the plurality of outer female engaging surfaces or engaging teeth disposed on the circumferential surface of the second pivot hole of the knob body are arranged with an equal angle with respect to one another.

3. The stove knob capable of automatically shutting down a stove in cooperation with heat as claimed in claim 1, wherein the plurality of outer female engaging surfaces disposed on the circumferential surface of the second pivot hole of the knob body have an included angle of 135 degrees between every two adjacent outer female engaging surfaces.

4. The stove knob capable of automatically shutting down a stove in cooperation with heat as claimed in claim 1, further comprising an automatic thermal shutdown machine with a driving part, and the knob body is passed and pivoted by the driving part.

5. A stove knob capable of automatically shutting down a stove in cooperation with heat, comprising a knob body and an adapter module installed to an ignition shaft of the stove with a selected orientation and a non-rotational pivoting connection; wherein the knob body has a rotary handle disposed at a side end of the knob body, a pivot body disposed at an opposite end of the rotary handle, a first pivot hole and a second pivot hole, communicating with each other and formed on the pivot body in an axial direction, and the first pivot hole is disposed at an inner end of the pivot body, and the second pivot hole is disposed at an outer end of the pivot body;

the adapter module comprising a first adapter and a second adapter, each provided with the selected orientation, and installed between the knob body and the corresponding ignition shaft, and the first adapter and the second adapter respectively having the same first inner coupling shaft and second inner coupling shaft, and the first adapter and the second adapter respectively having the same first outer coupling shaft and second outer coupling shaft, the first outer coupling shaft of the first adapter and the second outer coupling shaft of the second adapter being selectively coupled with the selected orientation to the second pivot hole of the knob body, and the first adapter and the second adapter having a first external hole and a second external hole with a same predetermined depth formed at an opposite end of the first inner coupling shaft and an opposite end of the second inner coupling shaft respectively, and the first inner coupling shaft being selectively coupled with a selected orientation to the first pivot hole of the knob body or the second external hole of the second adapter, and the second inner coupling shaft is selectively coupled with a selected orientation to the first pivot hole of the knob body or the first external hole of the first adapter, and a first shaft hole and a second shaft hole of different sizes being formed in the first inner coupling shaft and in the second inner coupling shaft respectively, and the first shaft hole and the second shaft hole communicating with the corresponding first external hole and second external hole respectively, and the first shaft hole and the second shaft hole being selectively provided for passing and engaging the corresponding ignition shaft.

6. The stove knob capable of automatically shutting down a stove in cooperation with heat as claimed in claim 5, wherein the knob body has a plurality of outer female engaging surfaces or engaging teeth disposed on a circumferential surface of the second pivot hole, and the first pivot hole of the knob body uses the plurality of outer female engaging surfaces or engaging teeth disposed on the circumferential surface of the second pivot hole as a base to provide a plurality of inner female engaging surfaces or engaging teeth of the same orientation and extending from the circumferential surface of the second pivot hole; and a circumferential surface of the first outer coupling shaft of the first adapter and a circumferential surface of the second outer coupling shaft of the second adapter similarly have a plurality of first outer male engaging surfaces or engaging teeth and a plurality of second outer male engaging surfaces or engaging teeth that can be passed and engaged with one another and are the same as those on the circumferential surface of the second pivot hole of the knob body respectively, and a circumferential surface of the first inner coupling shaft of the first adapter and a circumferential surface of the second inner coupling shaft of the second adapter have a plurality of first inner male engaging surfaces or engaging teeth and second inner male engaging surfaces or engaging teeth that can be passed and engaged with one another and are the same as those on a circumferential surface of the first pivot hole of the knob body respectively, and the first external hole of the first adapter and the second external hole of the second adapter have a plurality of first outer female engaging surfaces or engaging teeth and second outer female engaging surfaces or engaging teeth that can be passed and engaged with one another and are the same as those of the first inner coupling shaft and the second inner coupling shaft respectively.

7. The stove knob capable of automatically shutting down a stove in cooperation with heat as claimed in claim 6, wherein the plurality of outer female engaging surfaces or engaging teeth disposed on the circumferential surface of the second pivot hole of the knob body are arranged with an equal angle relative to one another.

8. The stove knob capable of automatically shutting down a stove in cooperation with heat as claimed in claim 6, wherein the plurality of outer female engaging surfaces disposed on the circumferential surface of the second pivot hole of the knob body are arranged with an included angle of 135 between every two adjacent outer female engaging surfaces.

9. The stove knob capable of automatically shutting down a stove in cooperation with heat as claimed in claim 5, further comprising an automatic thermal shutdown machine with a driving part, and the knob body being passed and pivoted by the driving part.

10. A stove knob capable of automatically shutting down a stove in cooperation with heat, comprising a knob body, an adapter module and a steering joint, and the adapter module and the steering joint being selected to be individually or mutually pivoted and then installed with a selected orientation and a non-rotational pivoting connection between the knob body and the ignition shaft of the stove;

wherein the knob body comprises a rotary handle disposed at a side end of the knob body, a pivot body disposed at an opposite side of the rotary handle, and a first pivot hole and a second pivot hole formed axially on the pivot body and communicating with each other, and the first pivot hole being disposed at an inner end of the pivot body, and the second pivot hole being disposed at an outer end of the pivot body;

the adapter module comprises a first adapter and a second adapter pivoted with the selected orientation and selectively to the knob body, and the first adapter and the second adapter have the same first inner coupling shaft and second inner coupling shaft respectively, and the first adapter and the second adapter respectively having the same first outer coupling shaft and second outer coupling shaft along an axial direction, and the first outer coupling shaft of the first adapter and the second outer coupling shaft of the second adapter are each provided with the selected orientation to the second pivot hole of the knob body, and the first adapter at the opposite end of the first inner coupling shaft and the second adapter at the opposite end of the second inner coupling shaft have a first external hole and a second external hole of a same predetermined depth respectively, and the first inner coupling shaft is selectively coupled with the selected orientation to the first pivot hole of the knob body or the second external hole of the second adapter, and the second inner coupling shaft is selectively coupled with the selected orientation to the first pivot hole of the knob body or the first external hole of the first adapter;

the steering joint is selectively coupled with a selected orientation to the first adapter or second adapter of the adapter module and installed between the knob body and the corresponding ignition shaft, and a circumferential surface of the steering joint has a pivoting portion, and both ends of the pivoting portion are selectively pivoted with a selected orientation to the first external hole of the first adapter or the second external hole of the second adapter, and both ends of the pivoting portion have a third shaft hole and a fourth shaft hole formed in the axial direction respectively, and the third shaft hole and the fourth shaft hole are of different sizes and selectively provided for passing and engaging the corresponding ignition shaft.

11. The stove knob capable of automatically shutting down a stove in cooperation with heat as claimed in claim 10, wherein a circumferential surface of the second pivot hole of the knob body has a plurality of outer female engaging surfaces or engaging teeth disposed thereon, and the first pivot hole of the knob body uses the plurality of outer female engaging surfaces or engaging teeth disposed on the circumferential surface of the second pivot hole as a base to provide a plurality of inner female engaging surfaces or engaging teeth with the same orientation and extending from the circumferential surface; a circumferential surface of the first outer coupling shaft of the first adapter and a circumferential surface of the second outer coupling shaft of the second adapter similarly have a plurality of first outer male engaging surfaces or engaging teeth and second outer male engaging surfaces or engaging teeth that can be passed and engaged with one another and are the same as those on the circumferential surface of the second pivot hole of the knob body respectively, and a circumferential surface of the first inner coupling shaft of the first adapter and a circumferential surface of the second inner coupling shaft of the second adapter have a plurality of first inner male engaging surfaces or engaging teeth and second inner male engaging surfaces or engaging teeth that can be passed and engaged with one another and are the same as those on a circumferential surface of the first pivot hole of the knob body respectively, and the first external hole of the first adapter and the second external hole of the second adapter have a plurality of first outer female engaging surfaces or engaging teeth and second outer female engaging surfaces or engaging teeth that can be passed and engaged with one another and are the same as those of the first inner coupling shaft and the second inner coupling shaft respectively, and the pivoting portion of the steering joint has a plurality of third male engaging surfaces or engaging teeth that can be passed and engaged with one another and are the same as those of the first external hole of the first adapter and the second external hole of the second adapter respectively.

12. The stove knob capable of automatically shutting down a stove in cooperation with heat as claimed in claim 11, wherein the plurality of outer female engaging surfaces or engaging teeth disposed on the circumferential surface of the second pivot hole of the knob body are arranged with an equal angle relative to one another.

13. The stove knob capable of automatically shutting down a stove in cooperation with heat as claimed in claim 11, wherein the plurality of outer engaging surfaces disposed on the circumferential surface of the second pivot hole of the knob body are arranged with an included angle of 135 degrees between every two adjacent outer engaging surfaces.

14. The stove knob capable of automatically shutting down a stove in cooperation with heat as claimed in claim 10, further comprising an automatic thermal shutdown machine with a driving part, and the knob body being passed and pivoted by the driving part.

* * * * *